United States Patent [19]

Grabbe et al.

[11] Patent Number: 4,606,594

[45] Date of Patent: Aug. 19, 1986

[54] ZIF CONNECTOR WITH WIPE

[75] Inventors: Dimitry G. Grabbe, Middletown; Iosif Korsunsky, Harrisburg, both of Pa.

[73] Assignee: AMP Incorporated, Harrisburg, Pa.

[21] Appl. No.: 725,695

[22] Filed: Apr. 22, 1985

[51] Int. Cl.[4] ..... H01R 9/09

[52] U.S. Cl. ..... 339/74 R; 339/176 MP

[58] Field of Search ..... 339/17 L, 74 R, 75 MP, 339/176 MP

[56] References Cited

U.S. PATENT DOCUMENTS

| | | | |
|---|---|---|---|
| 3,920,302 | 11/1975 | Cutchaw | 339/75 MP |
| 4,159,861 | 7/1979 | Anhalt | 339/75 MP |
| 4,165,909 | 8/1979 | Yeager et al. | 339/75 MP |
| 4,303,294 | 12/1981 | Hamsher, Jr. et al. | 339/74 R |

FOREIGN PATENT DOCUMENTS

| | | | |
|---|---|---|---|
| 1136235 | 11/1982 | Canada | 339/75 MP |

*Primary Examiner*—John McQuade

*Attorney, Agent, or Firm*—F. W. Raring

[57] ABSTRACT

A LIF or ZIF connector having improved contact wiping is disclosed herein. Briefly stated, a connector having contacts therein is provided with the contacts moving into or out of engagement with traces disposed on a daughter board. At the time of, or immediately after engagement of the contacts of the connector with the traces on the daughter board, a wiping cam causes the daughter board to be moved with respect to the contacts thereby causing a wiping action between the traces and the contacts.

5 Claims, 4 Drawing Figures

ZIF CONNECTOR WITH WIPE

BACKGROUND OF THE INVENTION

The invention relates, generally, to ZIF connectors and more particularly to a ZIF connector providing wipe without the movement of the contacts.

Zero insertion force or ZIF connectors are well known in the art and come in a variety of configurations. These types of connectors are being used in increasing numbers due to more and more complex circuitry and an increased need for reliability in adverse environments such as dust. Coincident with the increasing complexity of circuitry is the aspect of miniaturization which attempts to make connectors and therefore contacts smaller and smaller. This therefore makes the problem of good electrical contact very difficult. Accordingly, the present ZIF-type connectors attempt to accomplish wipe by the contacts upon their mating to conductive strips or traces on the daughter board. This has a tendency to produce relatively complex contact structures and camming mechanisms for moving contacts. Examples of ZIF or low insertion force connectors may be found in U.S. Pat. Nos. 4,303,294 "Compound Spring Contact" issued Dec. 1, 1981 to Hamsher, Jr. et al; 4,189,200 "Sequentially Actuated Zero Insertion Force Printed Circuit Board Connector" issued Feb. 19, 1980 to Yeager et al; and 3,899,234 "Low Insertion Force Cam Actuated Printed Circuit Board Connector" issued Aug. 12, 1975 to Yeager et al.

Accordingly, it is desirable to have a low or zero insertion force connector which ensures contact wipe without increasing the complexity of contact structures, which presents a very short electrical length, which is relatively inexpensive to manufacture and assemble, and which is usable with a large variety of low and zero insertion force connectors. Such a scheme is taught by the present invention.

Accordingly, it is desirable and is an object of the present invention to have a zero or low insertion force connector having wipe which is comprised of a first substrate having conductive traces thereon, a connector housing, electrical contacts disposed in the connector housing and in engagement with the conductive traces contained on the first substrate, an actuator disposed in the connector housing and a wiping cam disposed in the connector housing and cooperable with said actuator, characterized in that movement of the actuator causes the wiping cam to come into engagement with the first substrate, thereby urging the first substrate so as to cause a wiping action between the conductive traces and the electrical contacts.

BRIEF DESCRIPTION OF THE DRAWINGS

Reference may be now had to the accompanying drawings in which.

DESCRIPTION OF THE PREFERRED EMBODIMENT

Figure 1:
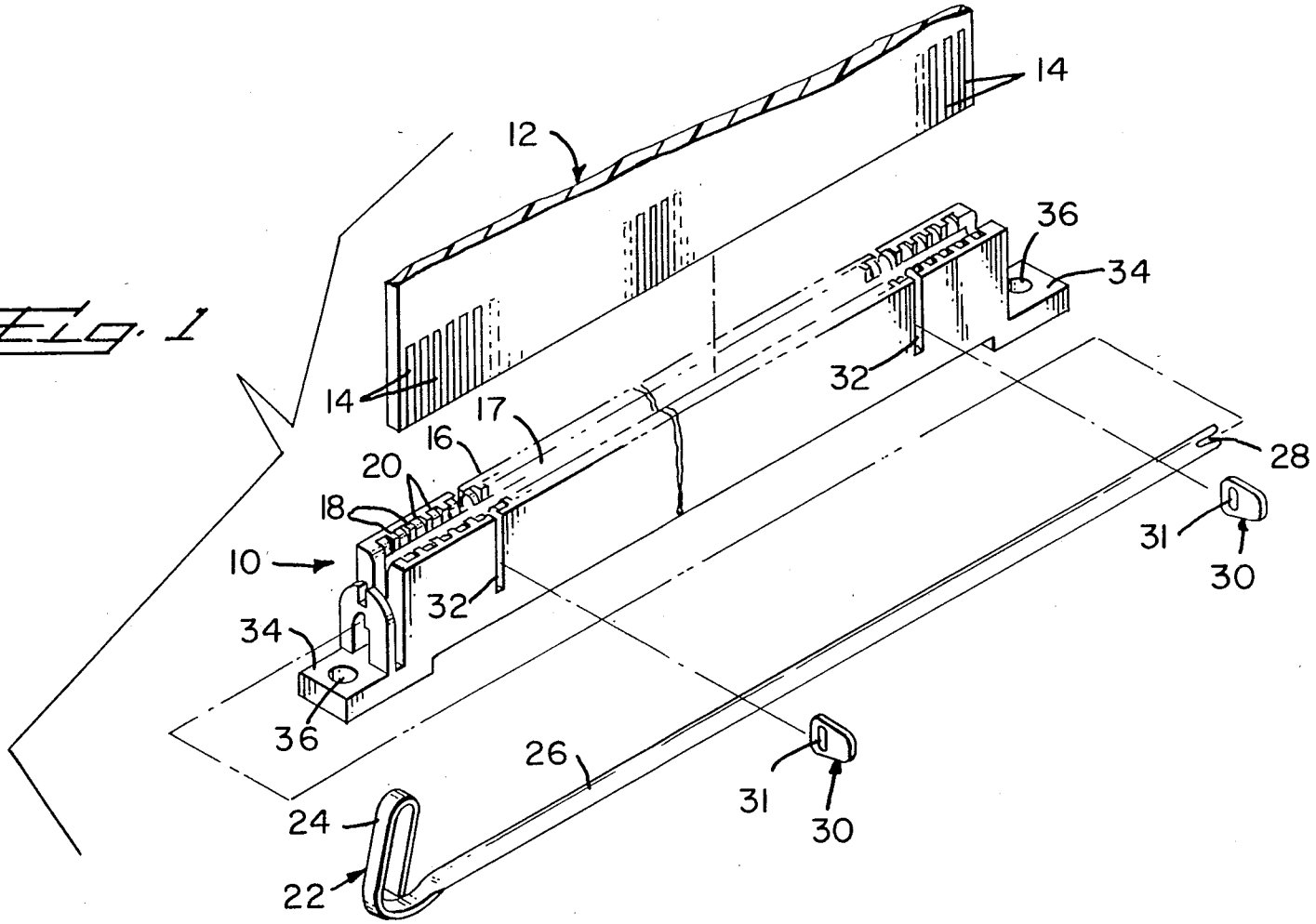
FIG. 1 is an isometric partly exploded view of the connector of the present invention.

Referring now to FIG. 1, there can be seen an isometric partly exploded view of the present invention. More particularly, a connector is shown generally at 10 which is matable with a daughter board which is shown generally at 12. The connector 10 would preferably be mounted on a mother board as is commonly known to one skilled in the art. However, other types of boards can and may be utilized without departing from the spirit and scope of the present invention. The daughter board 12 has oppositely facing major surfaces on which are provided conductive terminal traces 14 which would interconnect with circuitry disposed on the daughter board 12 (not shown). The general operation and structure of the connector shown in 10 is very similar to a wiping rotary zero insertion force connector manufactured and sold by AMP Incorporated, Harrisburg, Pa., and given the general part number of 532570. Additionally, general operation and theory of the connector may also be found in U.S. Pat. No. 3,899,234 "Low Insertion Force Cam Actuated Printed Circuit Board Connector" issued Aug. 12, 1975 to Yeager et al, and U.S. Pat. No. 4,303,294 "Compound Spring Contact" issued Dec. 1, 1981 to Hamsher, Jr. et al, both of which are specifically incorporated by reference herein. Accordingly, only a brief description of the actual connector housing and contacts will be found below with detailed description given to the contact wiping structure and operation of the present invention.

The connector 10 is generally comprised of a housing 16 which is preferably formed from plastic. Ears 34 are provided on the housing at each end thereof and holes 36 are provided in the ears for the reception of fasteners to secure the housing to a substrate such as a mother board. The housing has a channel 17 extending into one surface with contacts (not shown) received in the contact-receiving slots 20. Contact spacing barriers 18 are disposed between adjacent contacts. An actuator 22 which is comprised of an actuator handle 24, an actuator rod 26 and a mating end 28 is disposed transversely through the connector 10. The actuator 22 is used to urge the contacts and cams into or out of position as described more fully below. The mating end 28 of the actuator 22 is utilized to intersect with adjacent actuators (not shown) when connectors are ganged in a serial fashion (not shown). A wiping cam 30 having a wiping cam slot 31 disposed therein is disposed in the slots 32 contained in the housing 16, with the actuator rod 26 being placed through the wiping cam slots 31 in the wiping cam 30 with the operation of the wiping cams 30 described more fully below. Portions of the rod 26 serve as cams 48 for a cam follower 44 as will be explained below. The wiping cams 30 are, in effect, cam lobes on the rod 26.

Figure 3:
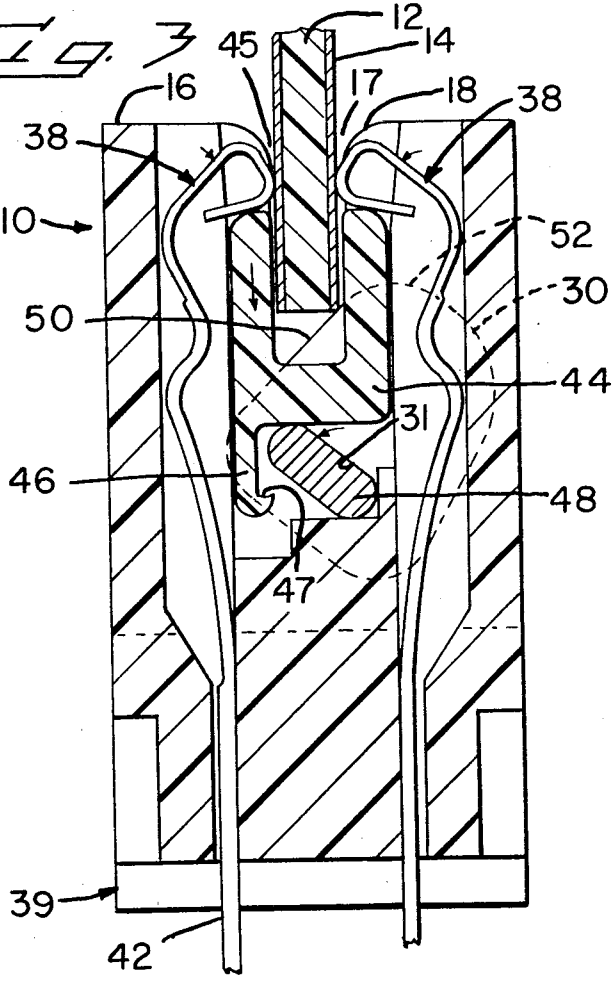
FIGS. 2, 3 and 4 show the insertion, mating and wiping of a daughter board for use with the connector of the present invention.
Figure 2:
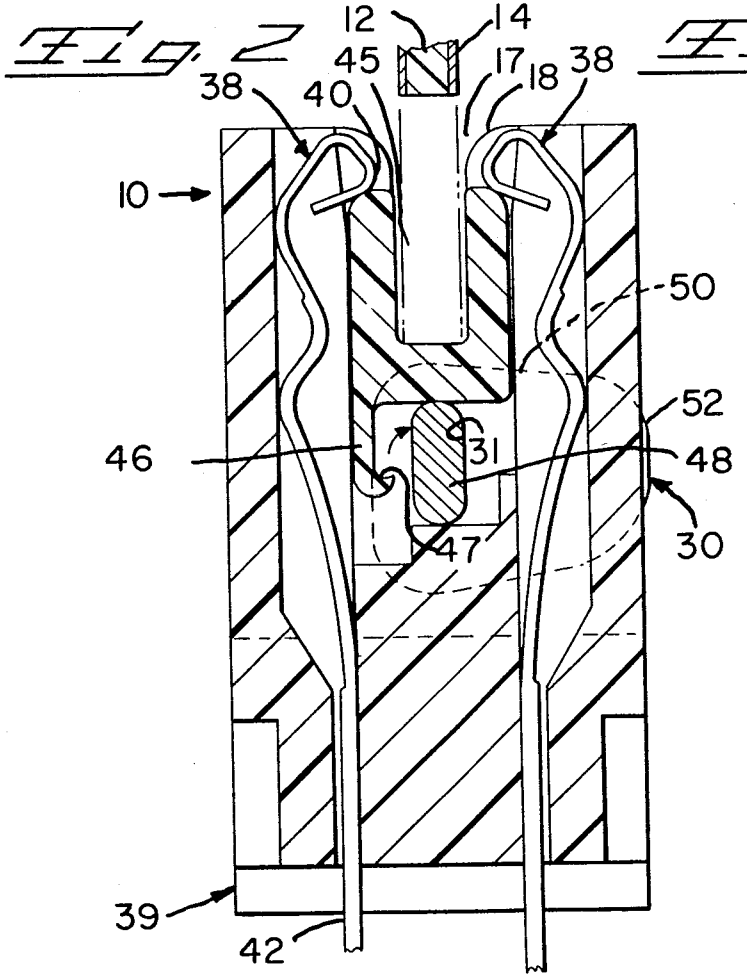
Figure 4:
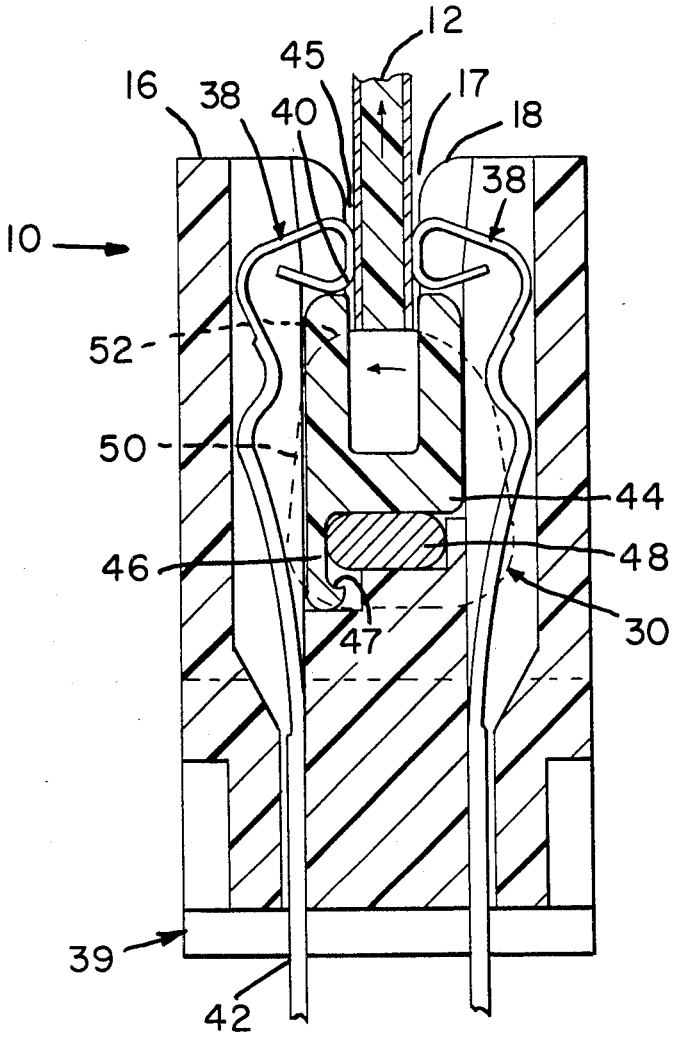

Referring now to FIG. 2, there is shown a cross-sectional view of the assembled connector shown in FIG. 1, immediately prior to placement of a daughter board into the connector. Accordingly, there is shown a daughter board 12 having conductive traces 14 disposed thereon above the connector 10 and in phantom disposed in the channel 17. In practice, the daughter board 12 would be inserted into the channel 17 with contact mating then taking place. As can be readily seen, the housing 16 has disposed therein contacts 38 having contact mating surfaces 40 thereon. It is to be understood that although particular types of contacts as shown in FIG. 2 are utilized in the preferred embodiment of the present invention, other types of contact arrangements and configurations may be utilized. Also shown is the connector 10 disposed on the mother board 39. A daughter board cam follower 44 has a slot 45 therein for receiving the daughter board 12. The cam follower 44 is utilized to urge the contacts 38 away from or into contact with the daughter board 12. The cam follower 44 has a cam follower leg 46 and a cam follower leg hook 47 which are used to engage the contact cam 48. The contact cam 48 causes the cam follower 44 to engage with each of the contacts 38 disposed in the connector 10 and although the follower is preferably a unitary piece going through the entire structure, individual cam followers may be utilized for each opposing contact pair. Similarly, the contact cam 48 is disposed through the length of the connector 10 and when rotated fully clockwise in the vertical position as shown, the cam follower 44 is urged vertically upwards toward the top of the connector housing 16 and thereby urges the contacts 38 away from the daughter board 12. Upon counterclockwise rotation of the contact cam 48, the contact cam 48 will engage the cam follower leg hook 47 and thereby pull the cam follower 44 vertically downwards as shown in FIGS. 3 and 4. This will therefore positively remove the cam follower 44 from the contacts 38. Similarly, the wiping cam 30 will rotate in the same clockwise or counterclockwise direction as the contact cam 48. The wiping cam 30 has a wiping cam dwell side at 50 and a wiping cam rise side at 52. Therefore when the contact cam 48 is in the vertical position, the wiping cam dwell side 50 of the wiping cam 30 is essentially disengaged from the daughter board 12. Also shown, is the position between the wiping cam 30 and the contact cam 48. The wiping cam 30 is disposed in a slot in the connector housing 16 as well as a slot in the cam follower 44, as shown in FIG. 1. Rotation of the contact cam 48 and also the wiping cam 30 are accomplished by rotation of the actuator 22 (FIG. 1).

Referring now to FIGS. 3 and 4, the operation of the present invention can be more readily seen. Accordingly, counterclockwise rotation of the actuator handle 24 (FIG. 1) causes the contact cam 48 to rotate counterclockwise from the full vertical position thereby allowing the cam follower 44 to move vertically downwards with the contacts 38 thereby going into engagement with the traces 14 contained on the daughter board 12 thereby resulting in contact mating forces. Coincidental with the rotation of the contact cam 48 is the engagement of the wiping cam rise side 52 contained on the wiping cam 30 with the lower edge of the daughter board 12 just at the time that contact mating forces being accomplished. However, it is to be understood that this engagement of the wiping cam 30 with the daughter board 12 may be accomplished after the cam follower 44 has completely finished its line of travel without departing from spirit and scope of the present invention. Continued counterclockwise rotation of the actuator handle 24 (FIG. 1) continues the counterclockwise rotation of the wiping cam 30. This thereby causes the wiping cam rise side 52 to fully come into engagement with the lower edge of the daughter board 12 thereby causing the daughter board to be urged vertically upwards away from the housing. This therefore causes wiping between the contact mating surfaces 40 contained on the contacts 38 and the traces 14. The amount of wipe accomplished is therefore directly equivalent to the amount of travel that is accomplished by the wiping cam 30. Accordingly, in this manner the contacts 38 need not accomplish a contact wiping action but need only exert contact mating forces which are typically perpendicularly or normal to the contact surfaces between the traces 14 and the contact mating surface 40. Accordingly, good electrical contact is ensured by bringing the contacts 38 into engagement with the traces 14 followed by movement of the daughter board 12 with respect to the contacts, by the wiping cam 30 thereby resulting in the mentioned wipe.

It is to be understood that many variations of the present invention may be accomplished without departing from the spirit and scope of the present invention. For example, the number or position of wiping cams may be changed or the shape of the wiping cams. Further, different types of contact and housing arrangements may be utilized as well as different types of actuators or actuator handles. Accordingly, the present invention produces a connector which is easy and inexpensive to manufacture, readily designable into existing connectors and greatly simplifies contact design, particularly in constricting spaces since the wiping aspect of contact engagement and disengagement need not be accomplished. Further, it is to be understood that the daughter board may be urged vertically downwards or sideways (rather than upwards) into the channel in order to accomplish contact wiping.

What is claimed is:

1. A multicontact electrical connector of the type comprising an insulating housing having a channel extending into one surface thereof for reception of edge portions of a substrate, the substrate having oppositely facing major surfaces and having terminal traces on the major surfaces adjacent to the edge portions thereof, contact terminals in the housing on each side of the channel, each terminal having a contact surface for engagement with a terminal trace, a rotatable camming rod extending through the housing and a cam follower in the housing which is moved towards and away from the one surface of the housing upon rotation of the camming rod in opposite directions, the cam follower being in engagement with the terminals and being effective to control movement of the contact surfaces towards and away from the channel upon rotation of the camming rod, the connector being characterized in that:

a wiping camming means is provided for moving the substrate in its own plane relative to the contact surfaces on a substrate positioned in the channel thereby to wipe the contact surfaces relatively over the terminal traces and ensure clean contact surfaces on the terminal traces and the contact surfaces, the wiping camming means comprising at least one cam lobe on the camming rod which is engageable with the one edge of the substrate.

2. An electrical connector as set forth in claim 1 characterized in that a plurality of cam lobes are provided on the camming rod at spaced-apart locations.

3. An electrical connector as set forth in claim 2 characterized in that each wiping cam lobe has a dwell portion and a rise portion, the dwell portion being in engagement with the one edge of the substrate during initial rotary movement of the camming rod and the rise portion being in engagement with the one edge during a final portion of the rotary movement of the camming rod.

4. An electrical connector as set forth in claim 3 characterized in that each wiping cam lobe comprises a plate-like member having an opening therein, the camming rod extending through the opening.

5. An electrical connector as set forth in claim 4 characterized in that the housing has cam lobe-receiving slots extending laterally from the channel for reception of the wiping cam lobes.

* * * * *